US009309700B2

(12) United States Patent
Miyagawa et al.

(10) Patent No.: US 9,309,700 B2
(45) Date of Patent: Apr. 12, 2016

(54) GLOVE COMPARTMENT DEVICE

(75) Inventors: Takuya Miyagawa, Miyazaki (JP); Kazuki Moro, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 143 days.

(21) Appl. No.: 13/818,604

(22) PCT Filed: Jul. 26, 2011

(86) PCT No.: PCT/JP2011/066907

§ 371 (c)(1), (2), (4) Date: Feb. 22, 2013

(87) PCT Pub. No.: WO2012/029445

PCT Pub. Date: Mar. 8, 2012

(65) Prior Publication Data

US 2013/0147212 A1 Jun. 13, 2013

(30) Foreign Application Priority Data

Sep. 1, 2010 (JP) ..... 2010-196020

(51) Int. Cl.

| | |
|---|---|
| ***E05C 3/02*** | (2006.01) |
| ***E05B 83/30*** | (2014.01) |
| *E05B 15/04* | (2006.01) |
| *E05B 85/26* | (2014.01) |

(52) U.S. Cl.

CPC ..... *E05B 83/30* (2013.01); *E05B 15/04* (2013.01); *E05B 85/26* (2013.01); *Y10T 292/1062* (2015.04)

(58) Field of Classification Search

CPC ..... E05B 83/30; E05B 15/04; E05B 85/26; Y10T 292/1062

USPC ..... 292/229, 219, 220, 224, 228, 194, 195, 292/198, 200, 216; 70/208, 210

See application file for complete search history.

(56) References Cited

U.S. PATENT DOCUMENTS 1,983,089 A * 12/1934 Knee ..... 232/15
5,267,761 A * 12/1993 Curtindale et al. ..... 292/81

FOREIGN PATENT DOCUMENTS

CN 101082255 A 12/2007
CN 101812947 A 8/2010

(Continued)

OTHER PUBLICATIONS

Japanese Office Action, dated Jul. 1, 2014, issued in Japanese Patent Application No. 201180042409.4.

(Continued)

*Primary Examiner* — Carlos Lugo
*Assistant Examiner* — Christine M Mills
(74) *Attorney, Agent, or Firm* — Arent Fox LLP

(57) ABSTRACT

A glove compartment device having a lock body being mounted directly on a lid and a latch urging spring provided between a pivoting latch and the lock body with a spring force urging the pivoting latch to the side where engagement with a striker is released. A plate spring that is mounted on the lock body so as to urge the striker to the side to disengage from the pivoting latch when the plate spring has one end thereof engaged with the lock body before mounting of the plate spring onto the lock body is completed. A latch urging spring is a torsion spring and has one end engaged with the lock body opposing the plate spring from the side that prevents disengagement of the one end of the plate spring from the lock body.

2 Claims, 8 Drawing Sheets

(56) References Cited

FOREIGN PATENT DOCUMENTS

| | | | | |
|---|---|---|---|---|
| JP | 2001-107626 | A | | 4/2001 |
| JP | 2006256378 | A | * | 9/2006 |
| JP | 2008-255701 | A | | 10/2008 |
| JP | 2010-105573 | A | | 5/2010 |

OTHER PUBLICATIONS

International Search Report issued in PCT/JP2011/066907, mailed Nov. 1, 2011, 1 page.

* cited by examiner

GLOVE COMPARTMENT DEVICE

CROSS-REFERENCED TO RELATED APPLICATIONS

This application is a National Stage entry of International Application PCT/JP2011/066907, filed Jul. 26, 2011, which claims priority to Japanese Application No. 2010-196020, filed Sep. 1, 2010, the disclosure of these prior applications are hereby incorporated in their entirety by reference.

TECHNICAL FIELD

The present invention relates to a glove compartment device that includes a lock body that is fixed to a lid that can open and close an opening of a compartment main body, a pivoting latch that is pivotably supported on the lock body so as to be engageable with a striker on the compartment main body side, an engagement member that is supported on the lock body so as to be movable between a position of the engagement with the pivoting latch that is in a state engaged with the striker and a position where the engagement is released, and responds to an operation from an exterior of the lid, a latch urging spring that is provided between the pivoting latch and the lock body while exhibiting a spring force that urges the pivoting latch to a side on which the engagement with the striker is released, and a plate spring that is mounted on the lock body so as to abut against the striker when the striker is engaged with the pivoting latch and urge the striker to a side on which the striker disengages from the pivoting latch.

BACKGROUND ART

A glove compartment device in which an operating handle having a cylinder lock is disposed at one end of a laterally extending base member mounted on a lid, and a lock mechanism that releases a locked state by operation of the operating handle when the cylinder lock is in an unlocked state is disposed at the other end of the base member is already known from Patent Document 1; in this lock mechanism, in order to suppress the occurrence of a noise due to colliding contact of a striker with a pivoting latch when closing the lid and in order to suppress rattling of the lid when it is in a closed state, a plate spring is mounted on a lock body, the plate spring urging the striker toward the side on which it disengages from the pivoting latch by abutting against the striker when the striker is engaged with the pivoting latch.

RELATED ART DOCUMENTS

Patent Documents

Patent Document 1: Japanese Patent Application Laid-open No. 2008-255701

SUMMARY OF THE INVENTION

Problems to be Solved by the Invention

A plate spring is usually mounted on a lock body by fastening or swaging, and an operation for the mounting thereof is complicated. In the arrangement disclosed by Patent Document 1, a complicated mounting operation such as a fastening operation is made unnecessary by retaining the plate spring assembled on the lock body by means of a base member mounted on the lock body, but this structure requires an arrangement in which the base member is mounted on the lock body, and cannot be achieved by a structure that does not require a base member.

The present invention has been accomplished in light of such circumstances, and it is an object thereof to provide a glove compartment device that is of a type that requires no base member due to a lock body being mounted directly on a lid and that can still eliminate the complication of an operation of mounting a plate spring onto a lock body.

Means for Solving the Problems

In order to attain the above object, according to a first aspect of the present invention, there is provided a glove compartment device comprising a lock body that is fixed to a lid that can open and close an opening of a compartment main body, a pivoting latch that is pivotably supported on the lock body so as to be engageable with a striker on the compartment main body side, an engagement member that is supported on the lock body so as to be movable between a position of the engagement with the pivoting latch that is in a state engaged with the striker and a position where the engagement is released, and responds to an operation from an exterior of the lid, a latch urging spring that is provided between the pivoting latch and the lock body while exhibiting a spring force that urges the pivoting latch to a side on which the engagement with the striker is released, and a plate spring that is mounted on the lock body so as to abut against the striker when the striker is engaged with the pivoting latch (19) and urge the striker to a side on which the striker disengages from the pivoting latch, characterized in that the plate spring has one end thereof engaged with the lock body before mounting of the plate spring onto the lock body is completed, and the latch urging spring, which is a torsion spring, has one end engaged with the lock body and disposed so as to oppose the plate spring from a side that prevents disengagement from the lock body of the one end of the plate spring engaged with the lock body.

According to a second aspect of the present invention, in addition to the first aspect, wherein the one end of the plate spring is fastened to the lid together with the lock body.

Effects of the Invention

In accordance with the first aspect of the present invention, since the one end of the plate spring is engaged with the lock body before mounting of the plate spring onto the lock body is completed, and the one end of the latch urging spring, which is a torsion spring, is engaged with the lock body and disposed so as to oppose the plate spring from the side that prevents disengagement of the one end of the plate spring from the lock body, it is possible to provisionally assemble the plate spring onto the lock body until the lock body is fixed to the lid, thereby eliminating the complication of an operation of mounting the plate spring onto the lock body.

Furthermore, in accordance with the second aspect of the present invention, since the one end of the plate spring, which is in a state engaged with the lock body, is fastened to the lid together with the lock body, it is possible to complete mounting of the plate spring onto the lock body at the same time as mounting of the lock body onto the lid, thus facilitating the assembly operation while decreasing the number of components.

EXPLANATION OF REFERENCE NUMERALS AND SYMBOLS

Figure 1:
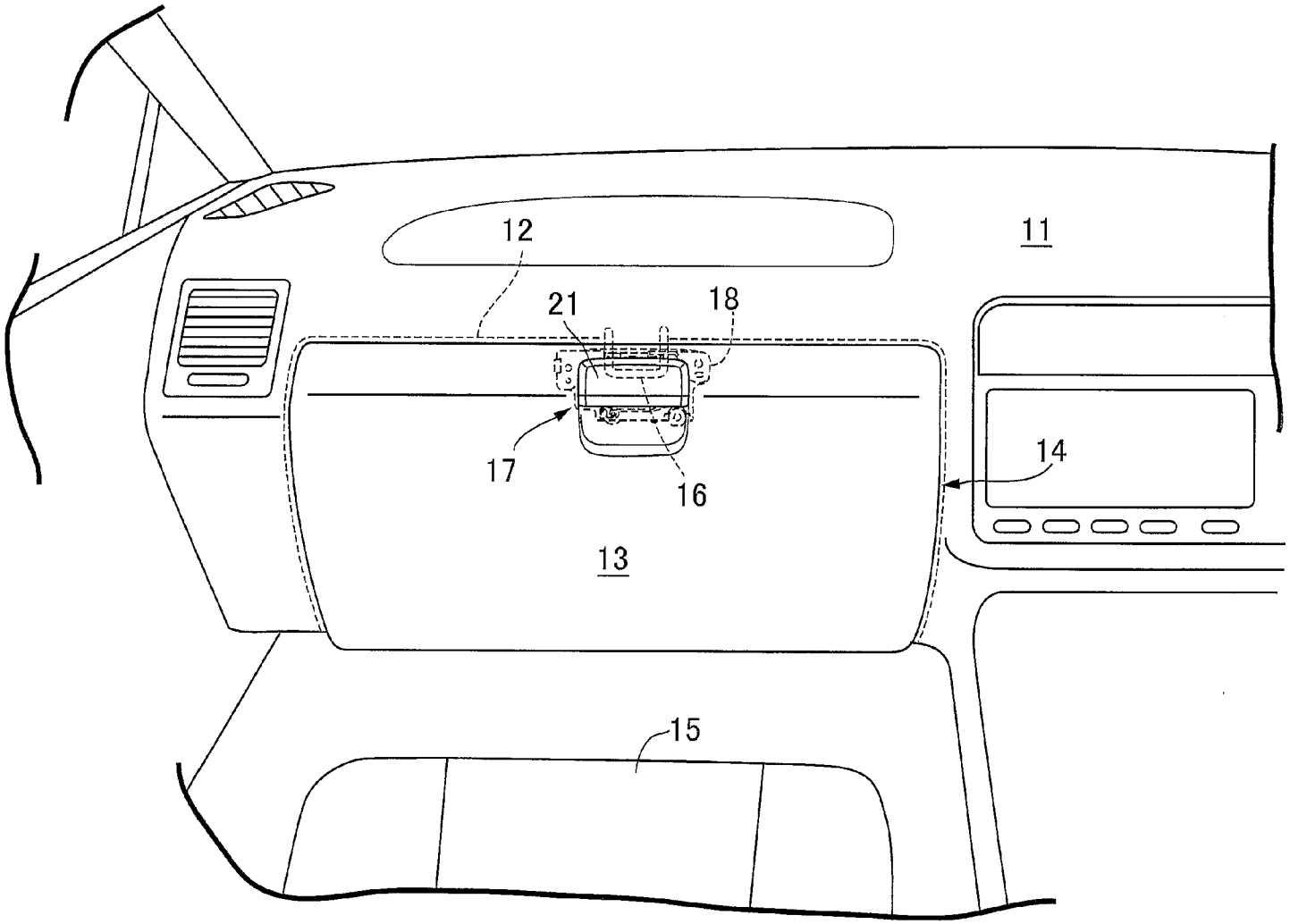
FIG. 1 is a front view of a glove compartment. (first embodiment)
Figure 2:
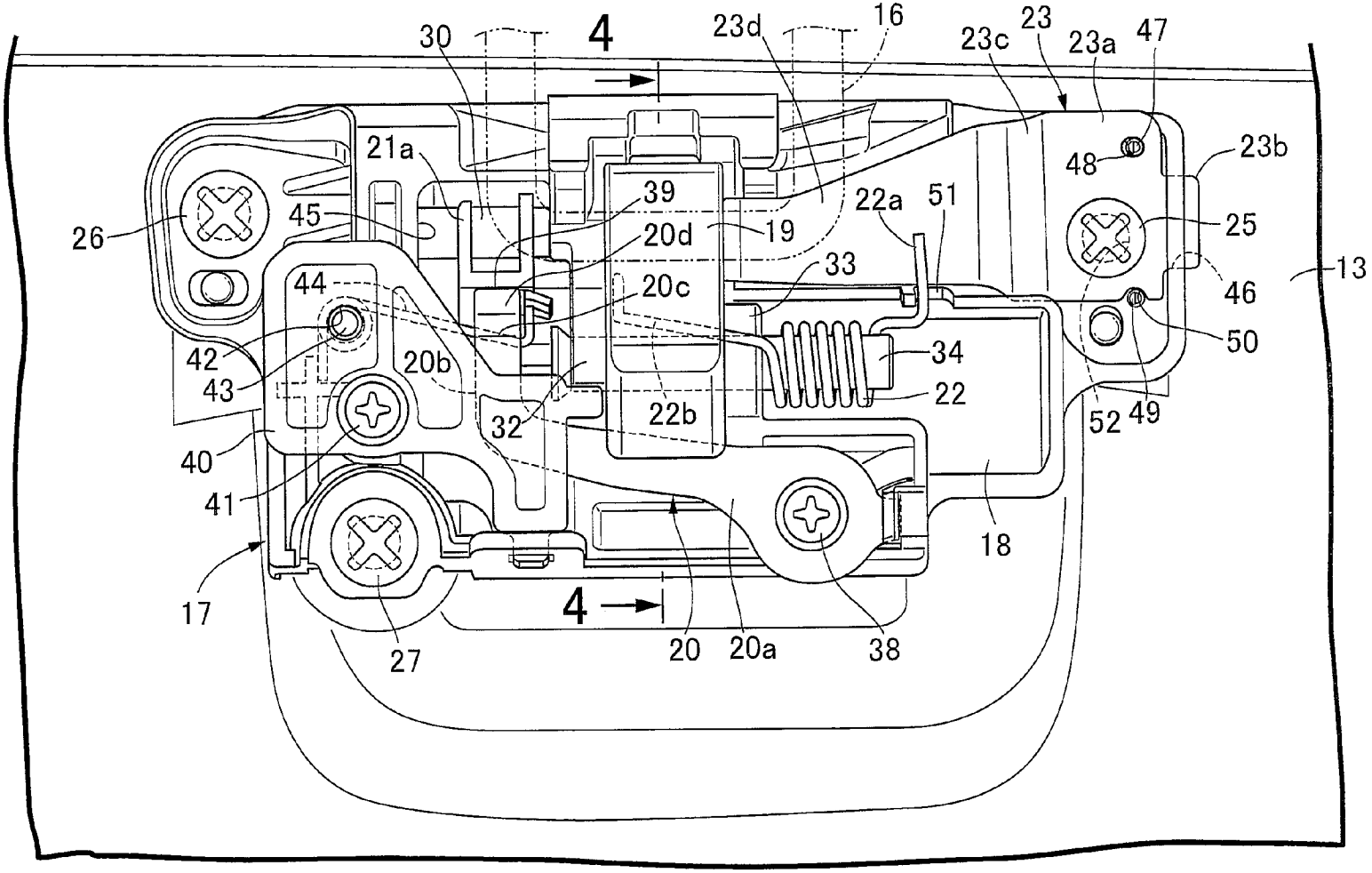
FIG. 2 is a front view when a lock mechanism is viewed from the reverse side of a lid. (first embodiment)
Figure 3:
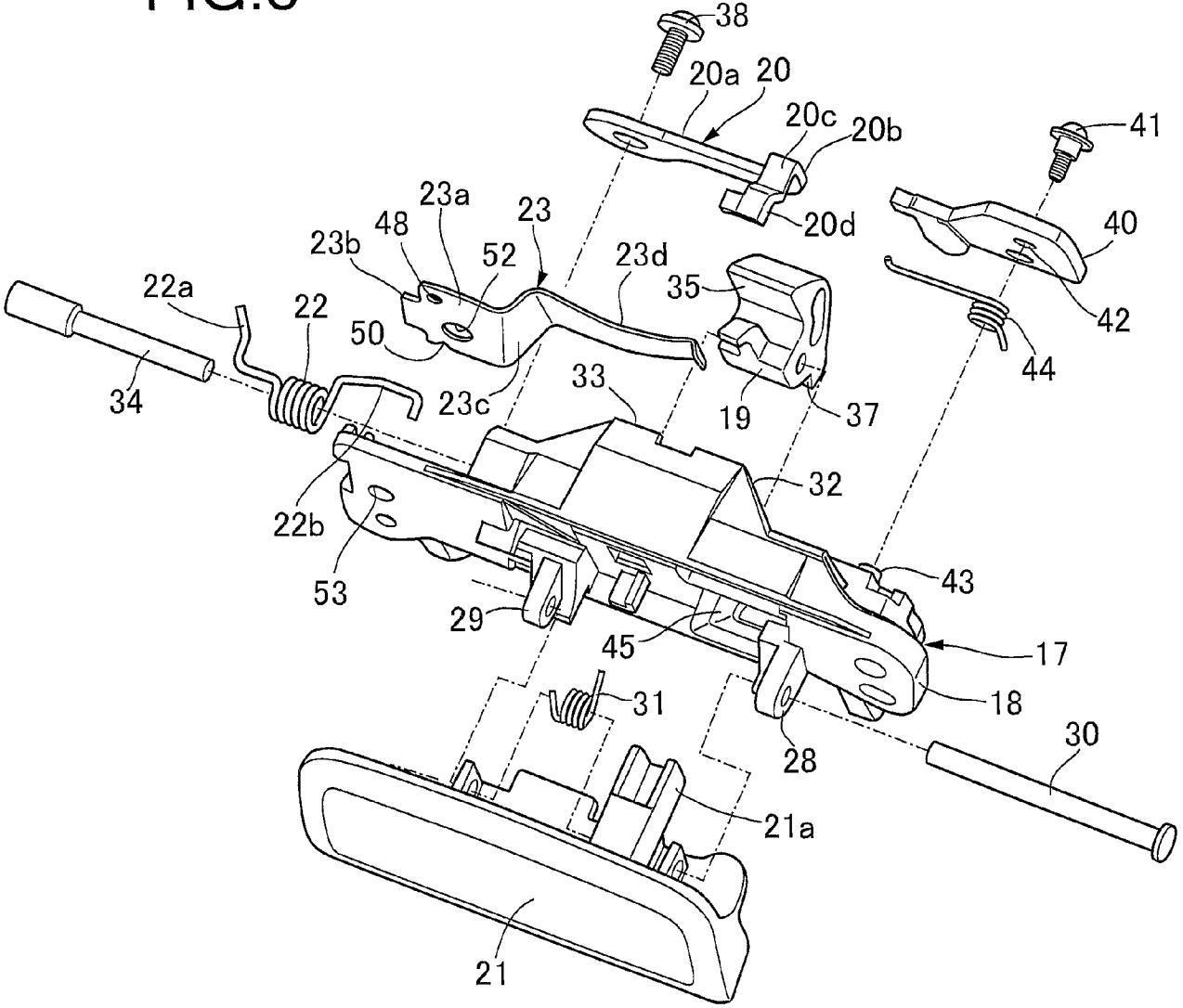
FIG. 3 is an exploded perspective view of the lock mechanism. (first embodiment)

12 Compartment main body
13 Lid
16 Striker
18 Lock body
19 Pivoting latch
20 Engagement member
22 Latch urging spring
22*a* One end of latch urging spring
23 Plate spring

MODES FOR CARRYING OUT THE INVENTION

A mode for carrying out the present invention is explained below by reference to the attached FIG. 1 to FIG. 8.

Embodiment 1

First, in FIG. 1, an instrument panel 11 disposed in a front part within a vehicle compartment of a passenger vehicle is provided with a glove compartment 14 formed from a compartment main body 12 that is integral with the instrument panel 11 and a lid 13 that can open and close an opening of the compartment main body 12, the glove compartment 14 being positioned forward of a passenger seat 15. Furthermore, the lid 13 is provided with a lock mechanism 17 that maintains a closed state of the lid 13 by engaging with a striker 16 provided on the compartment main body 12.

Referring in addition to FIG. 2 to FIG. 5, the lock mechanism 17 includes a lock body 18 that is fixed to the lid 13, a pivoting latch 19 that is pivotably supported on the lock body 18 so as to be engageable with the striker 16 on the compartment main body 12 side, an engagement member 20 that is supported on the lock body 18 so as to be movable between a position where it engages with the pivoting latch 19 that is in a state engaged with the striker 16 and a position where the engagement is released, an operating handle 21 that is pivotably supported on the lock body 18 so as to move the engagement member 20 and that is disposed on the surface side of the lid 13, a latch urging spring 22 that is provided between the pivoting latch 19 and the lock body 18 while exhibiting a spring force that urges the pivoting latch 19 to the side on which the engagement with the striker 16 is released, and a plate spring 23 that is mounted on the lock body 18 so as to abut against the striker 16 when the striker 16 is engaged with the pivoting latch 19, and exhibits a spring force urging the striker 16 to the side on which it is disengaged from the pivoting latch 19.

Figure 4:
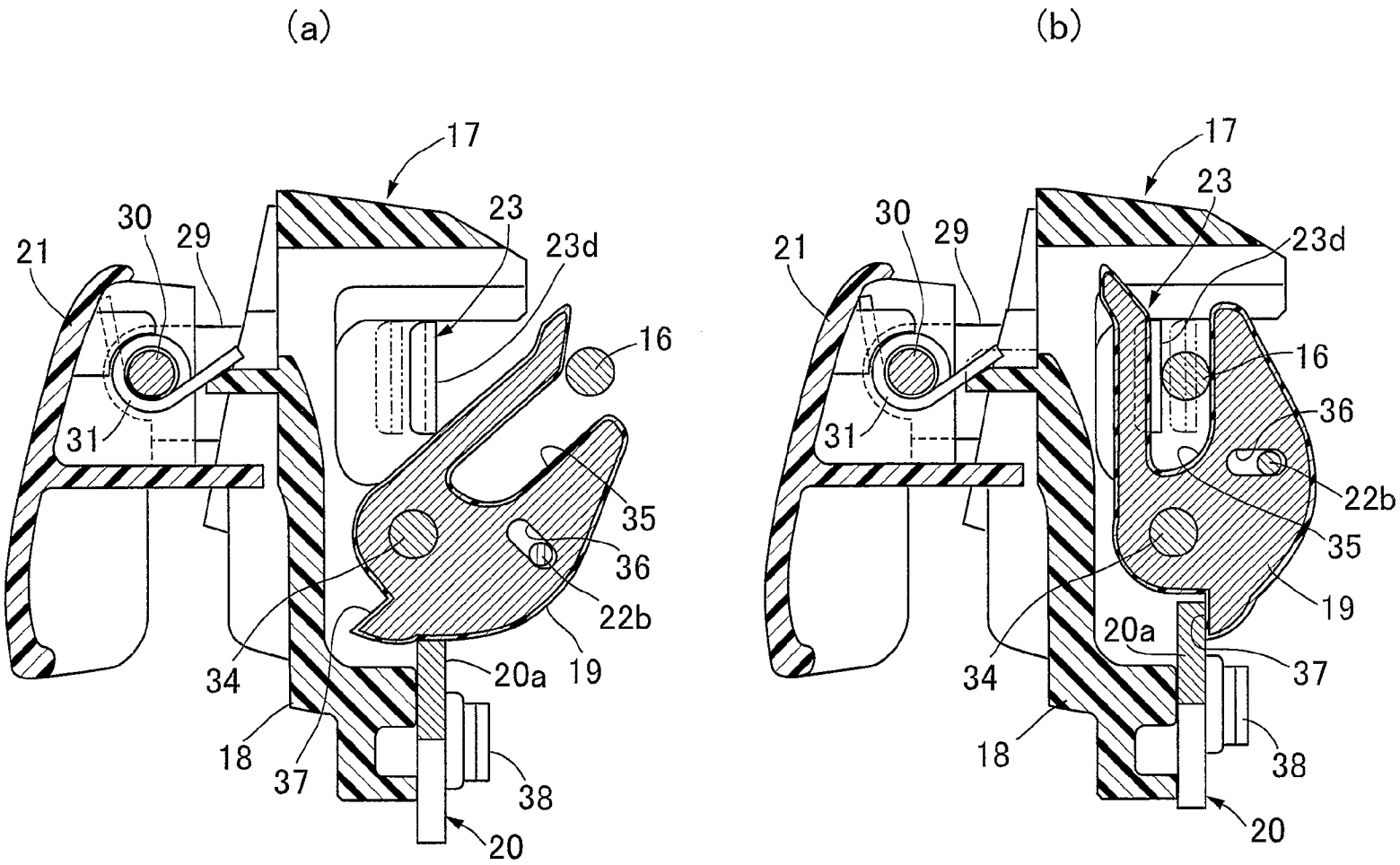
FIG. 4 is a sectional view along line 4-4 in FIG. 2 in a state in which a pivoting latch is at an open position (a) and a closed position (b). (first embodiment)

The lock body 18 is fastened to the reverse side of the lid 13 by means of a plurality of, for example three, bolts 25, 26, and 27 so that part of a front side of the lock body 18 extends to the front side of the lid 13 via an opening (not illustrated) of the lid 13, the operating handle 21 is pivotably supported via a first support shaft 30 on a pair of handle brackets 28 and 29 projectingly provided integrally with the surface of the lock body 18 so as to protrude from the surface of the lid 13, a return spring 31, which is a torsion spring, surrounding the first support shaft 30 is provided between the lock body 18 and the operating handle 21, and the operating handle 21 is urged by the return spring 31 toward the non-operated position side, that is, in an anticlockwise direction in FIG. 4.

On the other hand, a pair of latch brackets 32 and 33 are provided integrally with the reverse face of the lock body 18, the latch brackets 32 and 33 being spaced from each other, and the pivoting latch 19, which is disposed between these latch brackets 32 and 33, is pivotably supported by means of the two latch brackets 32 and 33 via a second support shaft 34 having an axis parallel to the first support shaft 30.

Figure 5:
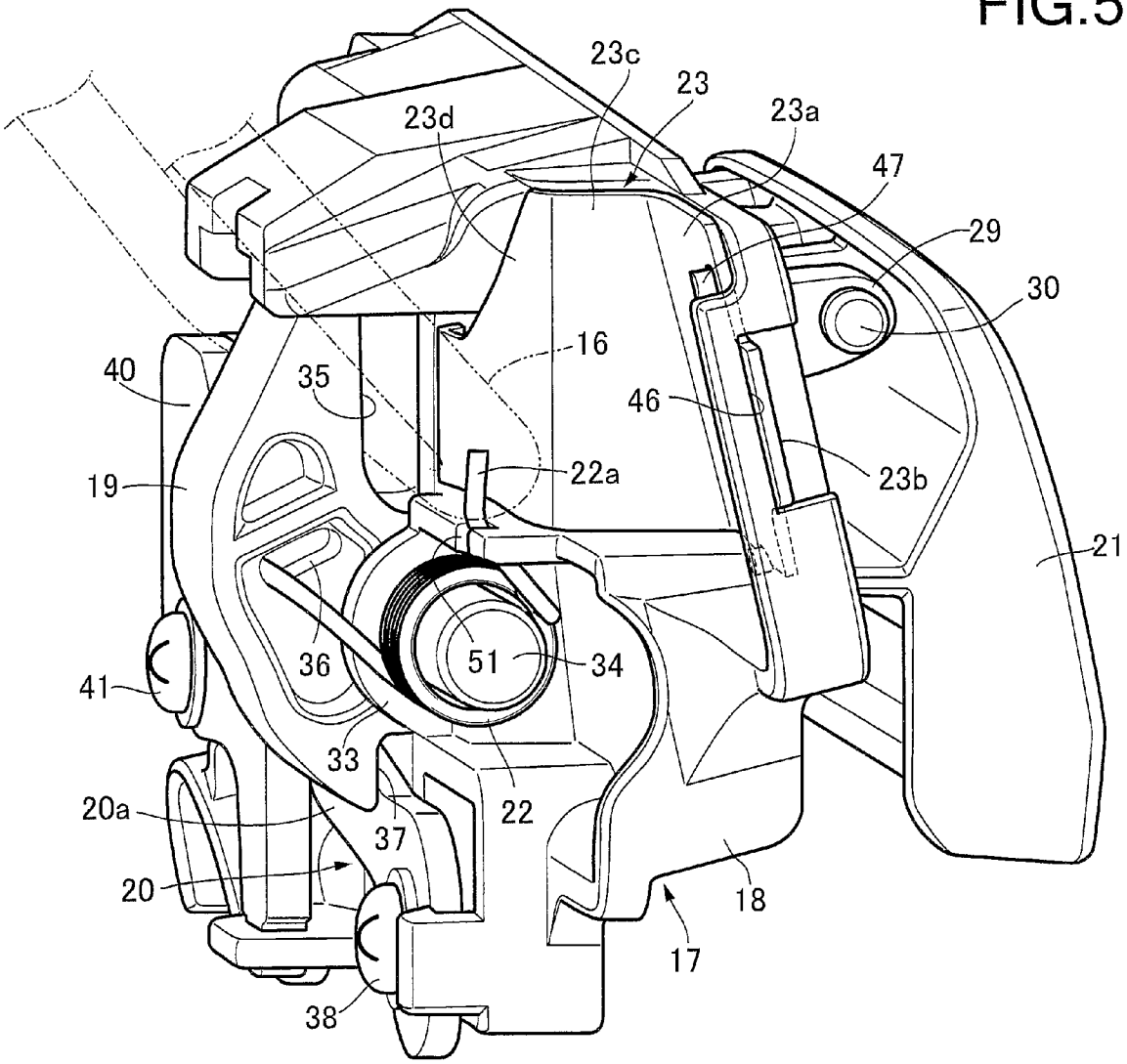
FIG. 5 is a perspective view showing the lock mechanism in a state in which the pivoting latch is at the closed position, with the lid omitted. (first embodiment)
Figure 6:
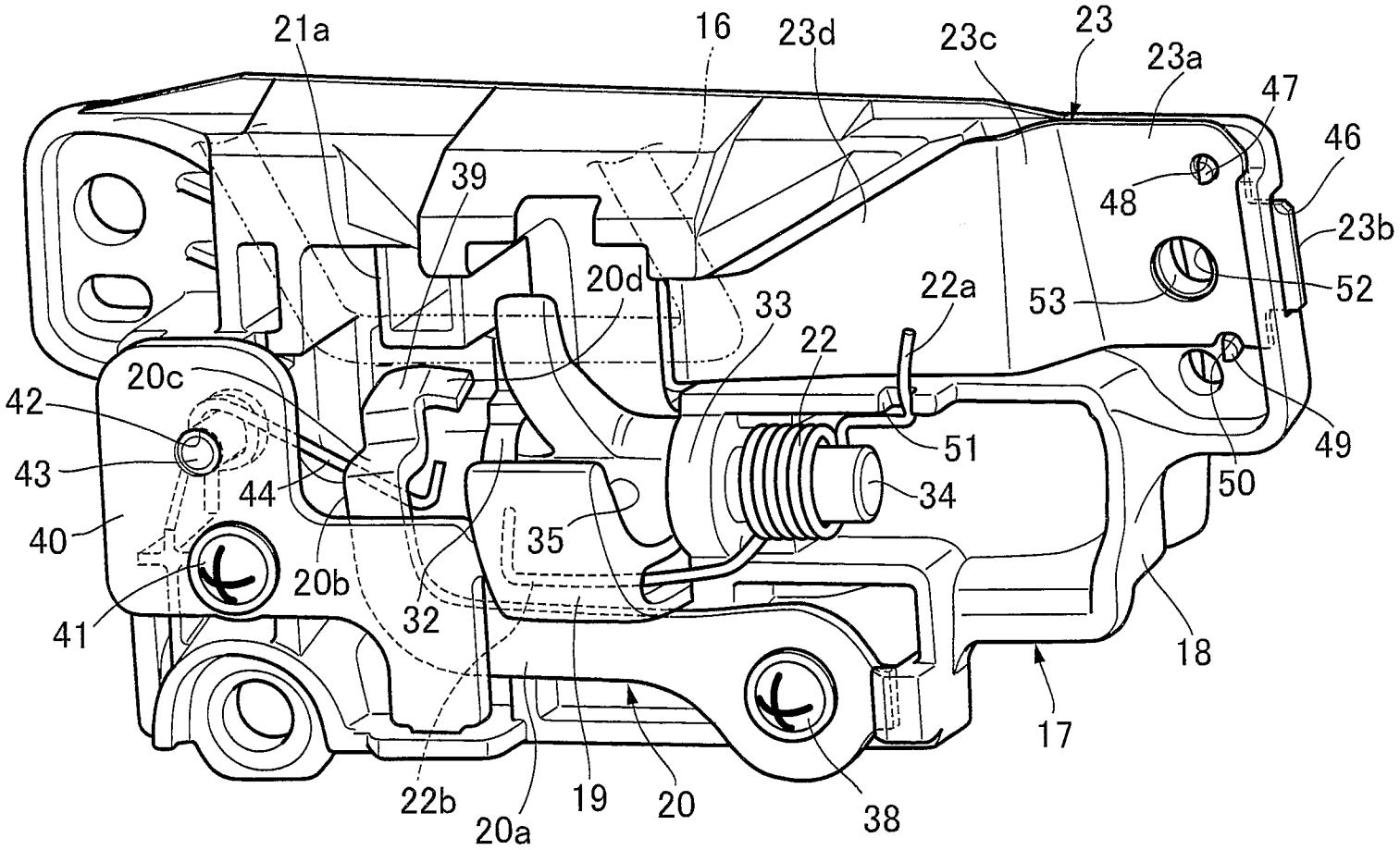
FIG. 6 is a perspective view of the lock mechanism when viewed from a different direction from that of FIG. 5 in a state in which the pivoting latch is at the open position, with the lid omitted. (first embodiment)
Figure 7:
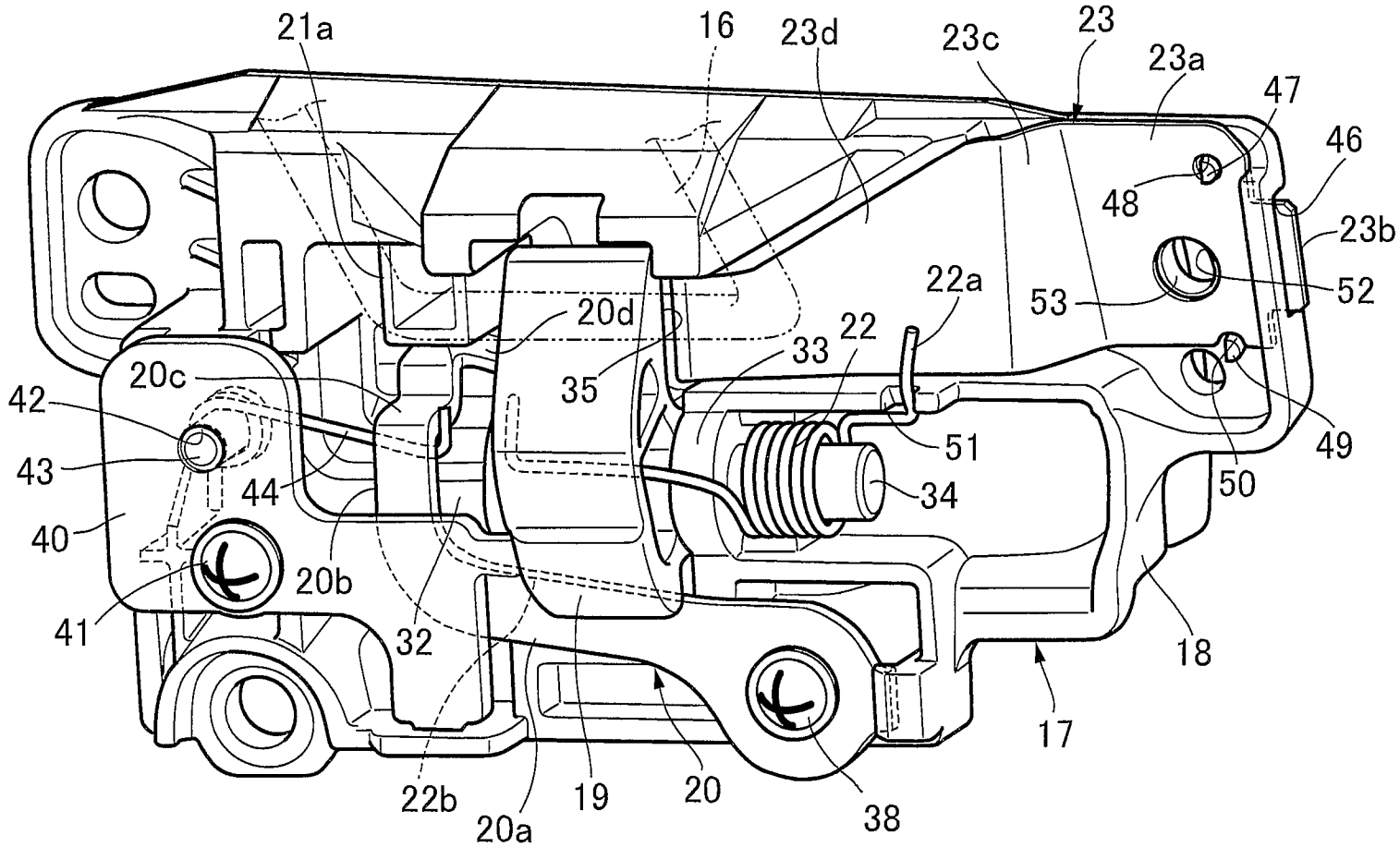
FIG. 7 is a perspective view, corresponding to FIG. 6, of the lock mechanism when the pivoting latch is at the closed position. (first embodiment)

Provided in the pivoting latch 19 is an engagement groove 35 with which the striker 16 engages; pivoting the lid 13 to the closing side in a state in which the pivoting latch 19 is at the open position shown in FIG. 4 (*a*) and FIG. 6 allows the pivoting latch 19 to be pushed by the striker 16 to pivot to the closed position shown in FIG. 4 (*b*), FIG. 5, and FIG. 7, and the striker 16 engages with the engagement groove 35. In this way, the engagement member 20 engages with the pivoting latch 19 in a state in which the striker 16 is engaged with the engagement groove 35, thus preventing the pivoting latch 19 from pivoting, and the lid 13 is thereby locked in a closed state.

The latch urging spring 22 provided between the pivoting latch 19 and the lock body 18 is a torsion spring that surrounds the second support shaft 34; one end 22*a* of this latch urging spring 22 is engaged with the lock body 18, and the other end 22*b* of the latch urging spring 22 is engaged with an engagement hole 36 provided in the pivoting latch 19. This latch urging spring 22 exhibits a spring force that pivotingly urges the pivoting latch 19 toward the open position side shown in FIG. 4 (*a*) and FIG. 6, that is, in a clockwise direction in FIG. 4.

The engagement member 20 restricts pivoting of the pivoting latch 19 in the closed position to the open position by engaging with a restricting step 37 provided on the pivoting latch 19, and is pivotably supported on the lock body 18 via a screw member 38 having an axis that is perpendicular to a plane containing the pivot axis of the pivoting latch 19.

The engagement member 20 is formed so as to integrally have a first arm portion 20*a* that extends in the width direction of the lid 13 beneath the pivoting latch 19 and has one end pivotably mounted on the lock body 18 by means of the screw member 38, a second arm portion 20*b* that extends in a vertical direction on one side of the pivoting latch 19 and has a lower end part provided so as to be connected to the other end of the first arm portion 20*a*, a spring retaining portion 20*c* that is provided so as to be connected at substantially right angles to an upper end part of the second arm portion 20*b* toward the reverse side of the lock body 18, and a portion to be pushed 20*d* that extends upward from the spring retaining portion 20*c* so as to form a flat abutment face 39 at the upper end. This engagement member 20 can pivot between a position where the first arm portion 20*a* is engaged with the restricting step 37 of the pivoting latch 19 in a state engaged with the striker 16 as shown in FIG. 4 (*b*), FIG. 5, and FIG. 7 and a position where the engagement of the first arm portion 20*a* with the pivoting latch 19 is released as shown in FIG. 4 (*a*) and FIG. 6.

Furthermore, a cover plate 40 is mounted on the lock body 18 by means of a single screw member 41 while a part of the cover plate 40 is engaged with the lock body 18, the cover plate 40 covering part of the first and second arm portions 20*b* in the engagement member 20 and guiding pivoting of the engagement member 20. A support pin 43 fitted into a support hole 42 provided in this cover plate 40 is integrally provided with the lock body 18. One end of a torsion spring 44 surrounding the support pin 43 is engaged with the cover plate 40, the other end of the torsion spring 44 is engaged with the spring retaining portion 20*c* of the engagement member 20, and the engagement member 20 is urged to the side on which the first arm portion 20*a* is engaged with the restricting step 37 of the pivoting latch 19 by virtue of the spring force exhibited by the torsion spring 44.

A pushing arm portion 21*a* is provided integrally with the operating handle 21, the pushing arm portion 21*a* extending through a through hole 45 provided in the lock body 18 and being capable of abutting from above against the abutment face 39 of the portion to be pushed 20*d* in the engagement member 20. Pivoting the operating handle 21 in the clockwise direction in FIG. 4 against the spring force of the return spring 31 makes the pushing arm portion 21*a* abut against the abutment face 39 of the engagement member 20 and push it downward, thus pivoting the engagement member 20 to a position where engagement of the first arm portion 20*a* with the restricting step 37 of the pivoting latch 19 is released. That is, the engagement member 20 pivots between a position where it engages with the pivoting latch 19 in a state engaged with the striker 16 and a position where the engagement is released according to pivoting of the operating handle 21 outside the lid 13.

Figure 8:
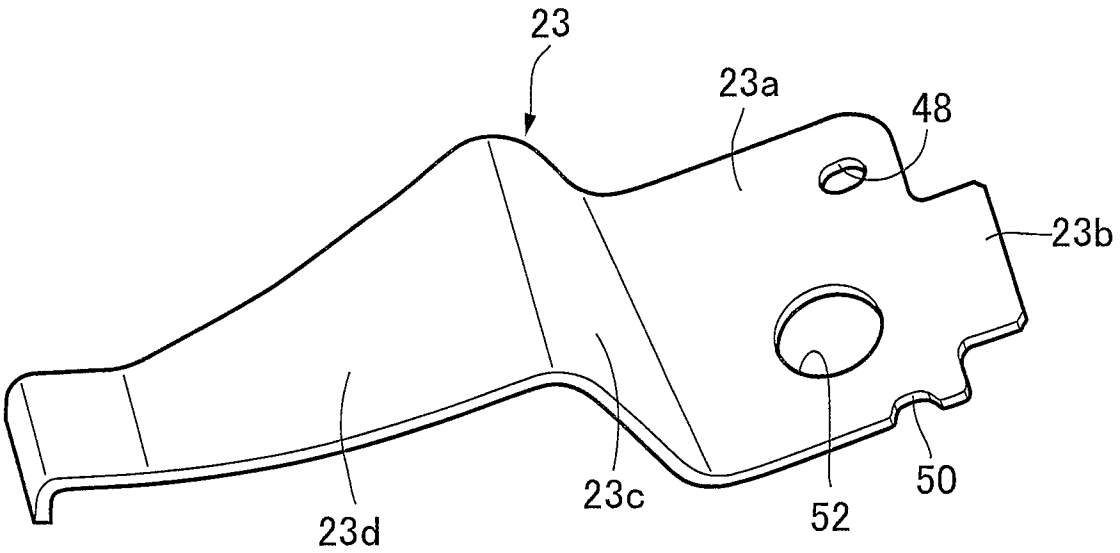
FIG. 8 is a perspective view of a plate spring. (first embodiment)

Referring in addition to FIG. 8, the plate spring 23 integrally has an abutment plate portion 23*a* that is formed into a flat plate shape so as to abut against the reverse face of the lock body 18, an engagement projection portion 23*b* that projects from one end of the abutment plate portion 23*a* so as to engage with an engagement hole 46 provided in the lock body 18, a support plate portion 23*c* that has one end provided so as to be connected at substantially right angles to the other end of the abutment plate portion 23*a* and extends toward a side away from the reverse face of the lock body 18, and a resilient plate portion 23*d* that is provided so as to be connected to the other end of the support plate portion 23*c* and extends toward the pivoting latch 19 side.

Provided in a portion closer to the one end of the abutment plate portion 23*a* are an engagement hole 48 and an engagement recess 50, the engagement hole 48 allowing a pin 47 projectingly provided on the reverse face of the lock body 18 to be inserted therethrough and engaged therewith, and the engagement recess 50 allowing a pin 49 projectingly provided on the reverse face of the lock body 18 to be engaged therewith. Engaging the engagement projection portion 23*b* with the engagement hole 46 and engaging the pins 47 and 49 with the engagement hole 48 and the engagement recess 50 enables the one end of the plate spring 23 to be engaged with the lock body 18.

The one end 22*a* of the latch urging spring 22, which is a torsion spring, is engaged with an engagement recess 51 provided in the lock body 18 at a position corresponding to the resilient plate portion 23*d* of the plate spring 23; the one end of the plate spring 23 before mounting on the lock body 18 is completed is engaged with the lock body 18, and the one end 22*a* of the latch urging spring 22 engaged with the engagement recess 51 is disposed so as to oppose the resilient plate portion 23*d* from the side that prevents the one end of the plate spring 23 engaged with the lock body 18 from disengaging from the lock body 18.

Making the one end 22*a* of the latch urging spring 22 oppose the resilient plate portion 23*d* makes the plate spring 23 resistant to becoming detached when provisionally assembling the plate spring 23 to the lock body 18, and in order to make the engagement with the lock body 18 more resistant to being released and to make the plate spring 23 resistant to becoming detached when provisionally assembling it to the lock body 18, the one end 22*a* of the latch urging spring 22 is bent toward the resilient plate portion 23*d* of the plate spring 23.

Furthermore, a bolt insertion hole 52 is provided in a part close to the one end of the abutment plate portion 23*a* in the plate spring 23, and a bolt insertion hole 53 is also provided in the lock body 18 so as to correspond to the bolt insertion hole 52. One bolt 25 among the bolts 25 to 27 fastening the lock body 18 to the reverse side of the lid 13 is inserted through the bolt insertion holes 52 and 53 and screwed into the lid 13. That is, the one end of the plate spring 23 is fastened, together with the lock body 18, to the lid 13 by means of the bolt 25.

An extremity of the resilient plate portion 23*d* in the plate spring 23 in a state of being mounted on the lock body 18 is present at the position shown by the solid line in FIG. 4 (*a*) and the chain line in FIG. 4 (*b*) in a state in which the striker 16 is not engaged with the engagement groove 35 of the pivoting latch 19, and abuts against the striker 16 and flexes to the position shown by the chain line in FIG. 4 (*a*) and the solid line in FIG. 4 (*b*) when the striker 16 engages with the pivoting latch 19, thus exhibiting a spring force that urges the striker 16 toward the side on which it is disengaged from the pivoting latch 19.

The operation of this embodiment is now explained: the plate spring 23, which abuts against the striker 16 when the striker 16 is engaged with the pivoting latch 19, and urges the striker 16 toward the side on which it disengages from the pivoting latch 19, is mounted on the lock body 18, and one end of this plate spring 23 is engaged with the lock body 18 before the plate spring 23 is mounted on the lock body 18. On the other hand, the latch urging spring 22 provided between the pivoting latch 19 and the lock body 18 is a torsion spring, and since the one end 22*a* of this latch urging spring 22 is engaged with the lock body 18 and disposed so as to oppose the plate spring 23 from the side that prevents disengagement from the lock body 18 of the one end of the plate spring 23 engaged with the lock body 18, it is possible to provisionally assemble the plate spring 23 onto the lock body 18 until the lock body 18 is fixed to the lid 13 and to eliminate the complication of an operation of mounting the plate spring 23 onto the lock body 18.

Moreover, since the one end of the plate spring 23 is fastened to the lid 13 together with the lock body 18, it is possible to complete mounting of the plate spring 23 onto the lock body 18 at the same time as mounting of the lock body 18 onto the lid 13, thus facilitating the assembly operation while decreasing the number of components.

An embodiment of the present invention is explained above, but the present invention may be modified in a variety of ways as long as the modifications do not depart from the spirit and scope thereof.

The invention claimed is:

1. A glove compartment device comprising a lock body that is fixed to a lid that can open and close an opening of a compartment main body, a pivoting latch that is pivotably supported on the lock body so as to be engageable with a striker on the compartment main body, an engagement member that is supported on the lock body so as to be movable between a position of engagement with the pivoting latch that is in a state engaged with the striker and a position where the engagement is released, and responds to an operation from an exterior of the lid, a latch urging spring that is provided between the pivoting latch and the lock body while exhibiting a spring force that urges the pivoting latch to a position in which the engagement with the striker is released, and a plate spring that is mounted on the lock body so as to abut against the striker when the striker is engaged with the pivoting latch and urge the striker to disengage from the pivoting latch, wherein the plate spring has a first side abutting against a reverse face of the lock body and a first end engaged with the lock body, and the latch urging spring, which is a torsion spring, has one end engaged with the lock body and in direct contact with a second side of the plate spring at a second end such that the latch urging spring prevents disengagement of the first end of the plate spring from the lock body.

2. The glove compartment device according to claim 1, wherein said first end of the plate spring is fastened to the lid together with the lock body.

* * * * *